US010333206B2

(12) United States Patent
Gondara et al.

(10) Patent No.: US 10,333,206 B2
(45) Date of Patent: Jun. 25, 2019

(54) VEHICLES, METHODS, AND SYSTEMS USING INTERNAL CAPACITY BAND ANTENNAS

(71) Applicant: GM GLOBAL TECHNOLOGY OPERATIONS LLC, Detroit, MI (US)

(72) Inventors: Parmeshwarjit S. Gondara, Farmington Hills, MI (US); Andrew J. MacDonald, Grosse Pointe Park, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 337 days.

(21) Appl. No.: 15/372,538

(22) Filed: Dec. 8, 2016

(65) Prior Publication Data

US 2018/0166774 A1 Jun. 14, 2018

(51) Int. Cl.

| | |
|---|---|
| ***H01Q 21/28*** | (2006.01) |
| ***H01Q 1/32*** | (2006.01) |
| ***H01Q 1/24*** | (2006.01) |

(52) U.S. Cl.

CPC ..... *H01Q 1/3275* (2013.01); *H01Q 1/241* (2013.01); *H01Q 1/3283* (2013.01); *H01Q 1/3291* (2013.01); *H01Q 21/28* (2013.01)

(58) Field of Classification Search

CPC ..... H01Q 1/32; H01Q 1/24; H01Q 21/28

USPC ..... 343/713

See application file for complete search history.

(56) References Cited

U.S. PATENT DOCUMENTS

2003/0009270 A1* 1/2003 Breed ..... B60C 11/24 701/32.4

* cited by examiner

*Primary Examiner* — Andrea Lindgren Baltzell

(74) *Attorney, Agent, or Firm* — Lorenz & Kopf, LLP

(57) ABSTRACT

Vehicles, systems, and methods are provided electronic communication in a vehicle. A vehicle includes a vehicle body, a first antenna cluster, and a second antenna cluster. The vehicle body defines a boundary between an inside of the vehicle and an outside of the vehicle. The first antenna cluster is mounted on the outside of the vehicle and is configured to operate at coverage band cellular telephone frequencies using coverage band signals. A second antenna cluster is disposed in the inside of the vehicle and is configured to operate at capacity band cellular telephone frequencies using capacity band signals.

20 Claims, 3 Drawing Sheets

VEHICLES, METHODS, AND SYSTEMS USING INTERNAL CAPACITY BAND ANTENNAS

TECHNICAL FIELD

The technical field generally relates to vehicles with internal cellular antennas, and more particularly relates to vehicle, methods, and systems that use internal capacity band antennas.

BACKGROUND

Vehicles are receiving an increasing number of wireless services, such as cellular phone service, satellite radio, terrestrial radio, and Global Positioning System (GPS) service. As additional wireless services become available, a vehicle must be equipped to accommodate the different types of signals. Many of these services require separate antennas to receive different radio frequencies. When designing antennas and antenna enclosures, designers focus on cost, aesthetics, and aerodynamics.

Conventional antennas typically have a single module that includes multiple antenna receiving elements. Each antenna element receives a different service or connection at a given frequency. With the expanding number of supported cellular telephone frequency bands, cellular antennas are becoming larger, more complex, and costlier. Furthermore, recent LTE performance enhancements can only be realized by introducing two or more additional antennas. As the size increases, the aerodynamic drag increases, which may cause wind noise and/or reduce fuel economy.

Accordingly, it is desirable to provide vehicles and systems that can reduce the size and cost of antenna modules. Furthermore, other desirable features and characteristics of the present invention will become apparent from the subsequent detailed description and the appended claims, taken in conjunction with the accompanying drawings and the foregoing technical field and background.

SUMMARY

Vehicles, systems, and methods are provided for electronic communication in a vehicle.

In one non-limiting example, a vehicle includes, but is not limited to, a vehicle body, a first antenna cluster, and a second antenna cluster. The vehicle body defines a boundary between an inside of the vehicle and an outside of the vehicle. The first antenna cluster is mounted on the outside of the vehicle and is configured to operate at coverage band cellular telephone frequencies using coverage band signals. A second antenna cluster is disposed in the inside of the vehicle and is configured to operate at capacity band cellular telephone frequencies using capacity band signals.

In another non-limiting example, a method is provided for electronic communication in a vehicle. The method includes, but is not limited to, receiving and transmitting coverage band signals with a first antenna cluster mounted on an outside of the vehicle and configured to operate at coverage band cellular telephone frequencies. The method further includes receiving and transmitting capacity band signals with a second antenna cluster disposed in the inside of the vehicle and configured to operate at capacity band cellular telephone frequencies.

In another non-limiting example, a vehicle communications system includes, but is not limited to, a first antenna cluster and a second antenna cluster. The first antenna cluster is configured to mount on the outside of the vehicle and to operate at coverage band cellular telephone frequencies using coverage band signals. The second antenna cluster is configured to be disposed in the inside of the vehicle and to operate at capacity band cellular telephone frequencies using capacity band signals.

DESCRIPTION OF THE DRAWINGS

The disclosed examples will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
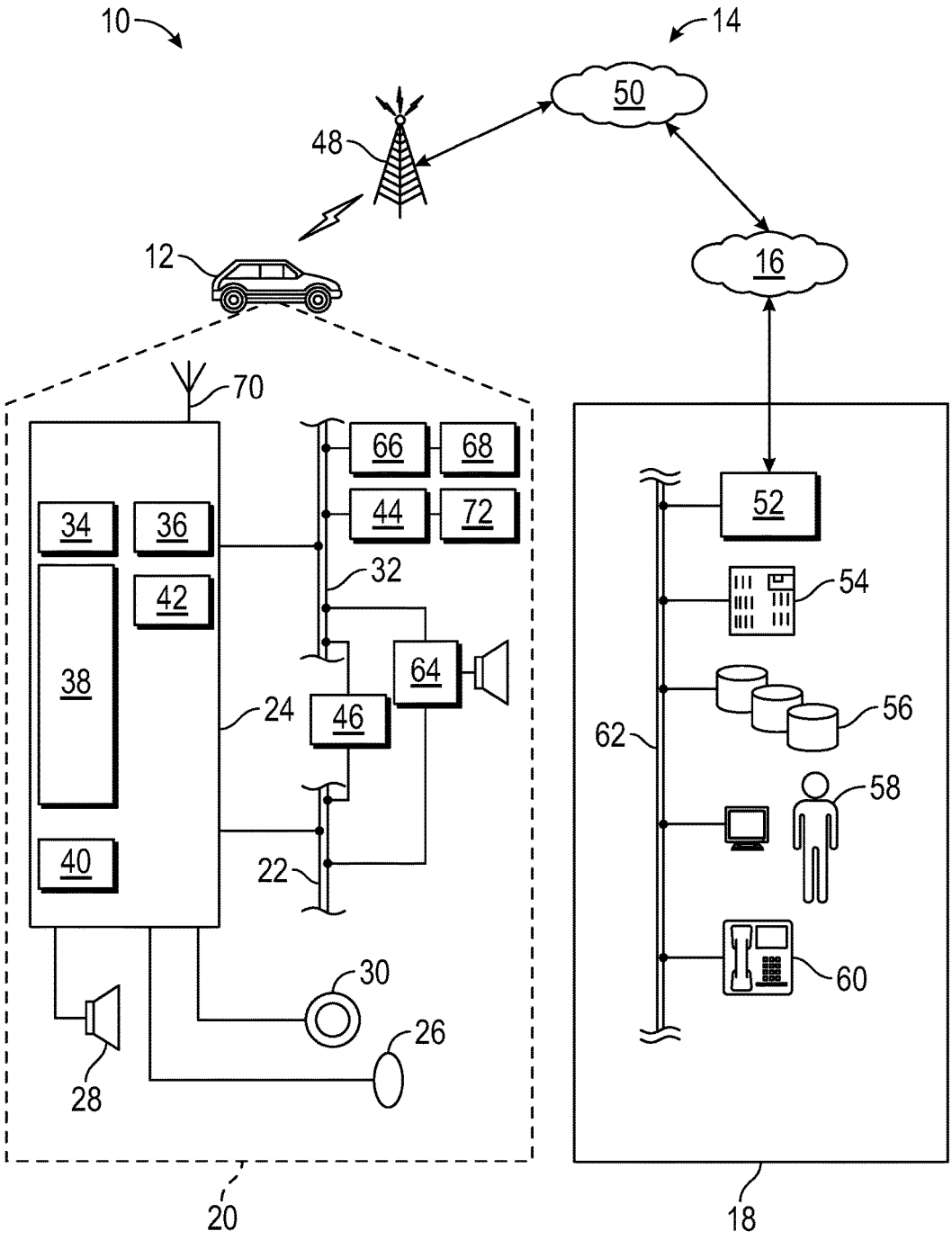
FIG. 1 is a diagram illustrating a non-limiting example of a communication system.

With reference to FIG. 1, there is shown a non-limiting example of a communication system 10 that may be used together with examples of the apparatus/system disclosed herein or to implement examples of the methods disclosed herein. Communication system 10 generally includes a vehicle 12, a wireless carrier system 14, a land network 16 and a call center 18. It should be appreciated that the overall architecture, setup and operation, as well as the individual components of the illustrated system are merely exemplary and that differently configured communication systems may also be utilized to implement the examples of the method disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, etc., and is equipped with suitable hardware and software that enables it to communicate over communication system 10. Some of the vehicle hardware 20 is shown generally in FIG. 1 including a telematics unit 24, a microphone 26, a speaker 28, and buttons and/or controls 30 connected to the telematics unit 24. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard device that provides a variety of services through its communication with the call center 18, and generally includes an electronic processing device 38, one or more types of electronic memory 40, a cellular chipset/component 34, a wireless modem 36, a dual mode antenna 70, and a navigation unit containing a GNSS chipset/component 42. In one example, the wireless modem 36 includes a computer program and/or set of software routines adapted to be executed within electronic processing device 38.

The telematics unit 24 may provide various services including: turn-by-turn directions and other navigation-related services provided in conjunction with the GNSS chipset/component 42; airbag deployment notification and other emergency or roadside assistance-related services provided in connection with various crash and/or collision sensor interface modules 66 and collision sensors 68 located throughout the vehicle; and/or infotainment-related services where music, internet web pages, movies, television programs, videogames, and/or other content are downloaded by an infotainment center 46 operatively connected to the telematics unit 24 via vehicle bus 32 and audio bus 22. In one example, downloaded content is stored for current or later playback. The above-listed services are by no means an exhaustive list of all the capabilities of telematics unit 24, but are simply an illustration of some of the services that the telematics unit may be capable of offering. It is anticipated that telematics unit 24 may include a number of additional components in addition to and/or different components from those listed above.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. Any suitable encoding or modulation technique may be used with the present examples, including digital transmission technologies, such as TDMA (time division multiple access), CDMA (code division multiple access), W-CDMA (wideband CDMA), FDMA (frequency division multiple access), OFDMA (orthogonal frequency division multiple access), etc.

Dual mode antenna 70 services the GNSS chipset/component 42 and the cellular chipset/component 34.

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with the telematics unit 24 or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more of the vehicle hardware components 20. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The audio component 64 is operatively connected to the vehicle bus 32 and the audio bus 22. The audio component 64 receives analog information, rendering it as sound, via the audio bus 22. Digital information is received via the vehicle bus 32. The audio component 64 provides amplitude modulated (AM) and frequency modulated (FM) radio, compact disc (CD), digital video disc (DVD), and multimedia functionality independent of the infotainment center 46. Audio component 64 may contain a speaker system, or may utilize speaker 28 via arbitration on vehicle bus 32 and/or audio bus 22.

The vehicle crash and/or collision detection sensor interface 66 is operatively connected to the vehicle bus 32. The collision sensors 68 provide information to the telematics unit via the crash and/or collision detection sensor interface 66 regarding the severity of a vehicle collision, such as the angle of impact and the amount of force sustained.

Vehicle sensors 72, connected to various sensor interface modules 44 are operatively connected to the vehicle bus 32. Example vehicle sensors include but are not limited to gyroscopes, accelerometers, magnetometers, emission detection, and/or control sensors, and the like. Example sensor interface modules 44 include powertrain control, climate control, and body control, to name but a few.

Wireless carrier system 14 may be a cellular telephone system or any other suitable wireless system that transmits signals between the vehicle hardware 20 and land network 16. According to an example, wireless carrier system 14 includes one or more cell towers 48

Land network 16 can be a conventional land-based telecommunications network that is connected to one or more landline telephones, and that connects wireless carrier system 14 to call center 18. For example, land network 16 can include a public switched telephone network (PSTN) and/or an Internet protocol (IP) network, as is appreciated by those skilled in the art. Of course, one or more segments of the land network 16 can be implemented in the form of a standard wired network, a fiber or other optical network, a cable network, other wireless networks such as wireless local networks (WLANs) or networks providing broadband wireless access (BWA), or any combination thereof.

Call center 18 is designed to provide the vehicle hardware 20 with a number of different system back-end functions and, according to the example shown here, generally includes one or more switches 52, servers 54, databases 56, advisors 58, as well as a variety of other telecommunication/computer equipment 60. These various call center components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either advisor 58 or an automated response system, and data transmissions are passed on to a modem or other piece of telecommunication/computer equipment 60 for demodulation and further signal processing. The modem or other telecommunication/computer equipment 60 may include an encoder, as previously explained, and can be connected to various devices such as a server 54 and database 56. For example, database 56 could be designed to store subscriber profile records, subscriber behavioral patterns, or any other pertinent subscriber information. Although the illustrated example has been described as it would be used in conjunction with a call center 18 that is manned, it will be appreciated that the call center 18 can be any central or remote facility, manned or unmanned, mobile or fixed, to or from which it is desirable to exchange voice and data.

Figure 2:
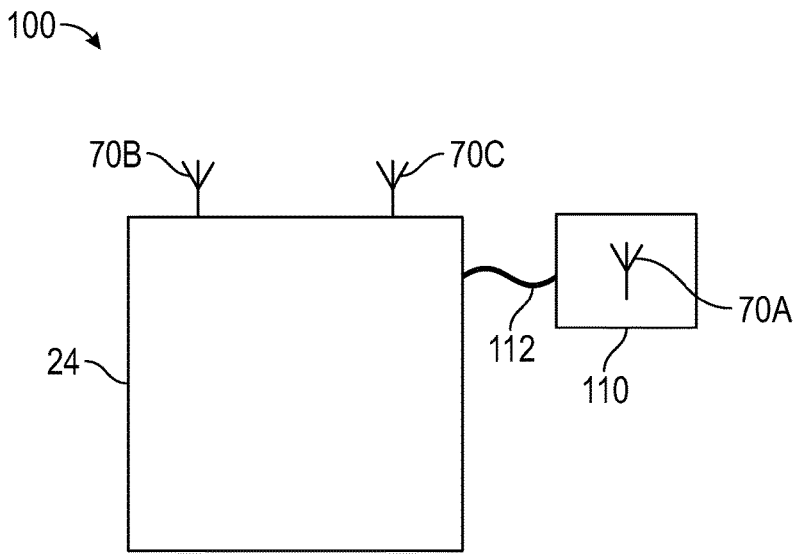
FIG. 2 is a diagram illustrating a non-limiting example of a system for cellular communications in a vehicle made in accordance with the teachings disclosed herein.

Referring now to FIG. 2, and with continued reference to FIG. 1, there is shown a non-limiting example of a system 100 for cellular communications in a vehicle. It should be appreciated that the overall architecture, setup and operation, as well as the individual components of the illustrated system 100 are merely exemplary and that differently configured systems may also be utilized to implement the examples of the system 100 disclosed herein. Thus, the following paragraphs, which provide a brief overview of the illustrated system 100, are not intended to be limiting.

Compared with conventional systems, system 100 generally provides a smaller and less expensive external antenna cluster that only covers bands likely to exist at the edge of cellular telephone service coverage (e.g., coverage bands). Lower gain internal antennas cover the remaining bands (e.g., capacity bands), which are less sensitive to antenna gain in capacity band areas, as will be described below. A telematics unit is configured to demodulate the capacity band signals and the coverage band signals, where the telematics unit is communicatively coupled with the external antenna cluster and the internal antenna cluster.

System 100 includes components of wireless carrier system 14, where like numbers refer to like components. In the example provided, system 100 includes telematics unit 24, a first antenna cluster 70A, a second antenna cluster 70B, a third antenna cluster 70C, a waterproof housing 110, and a transmission cable 112.

First antenna cluster 70A is configured to be mounted on the outside of vehicle 12 and is configured to operate at coverage band cellular telephone frequencies using coverage band signals. Second antenna cluster 70B is disposed in the inside of vehicle 12 and is configured to operate at capacity band cellular telephone frequencies using capacity band signals. Third antenna cluster 70C is disposed in the inside of the vehicle and is configured to receive the coverage band signals. In some embodiments, third antenna cluster 70C is omitted. In the example provided, second and third antenna clusters 70B-C are secured directly to a circuit board within telematics unit 24.

In the example provided, first antenna cluster 70A composes the entirety of external cellular antennas of the vehicle. For example, no other external cellular antennas are present on vehicle 12. In embodiments where first antenna cluster 70A composes an entirety of external cellular antennas of vehicle 12, no antennas configured to operate at capacity band cellular telephone frequencies are disposed on the outside of vehicle 12.

As used herein, the term "configured to operate at" refers to the physical design of the antenna such that the antenna is principally operable to receive and transmit radio frequency signals at the stated frequencies, as will be readily appreciated by those of ordinary skill in the art. Conventional cellular technology is supported by frequency bands ranging from 450 MHz to 4 GHz. As will be appreciated by those with ordinary skill in the art, radio wave propagation degrades as the frequency of a radio wave increases. Accordingly, high frequency signals do not travel as far as low frequency signals. Because the low frequency signals travel farther, the low frequency signals are often used in rural areas where a large coverage area is desirable. In contrast, high frequency bands are often used to increase capacity in urban and suburban areas. As used herein, the term "coverage band cellular telephone frequencies" refers to radio wave cellular telephone frequencies at or below about 2 GHz. As used herein, the term "capacity band cellular telephone frequencies" refers to radio wave cellular telephone frequencies above about 2 GHz.

Waterproof housing 110 may be any suitable weather resistant antenna housing for use on an exterior of vehicle 12. For example, waterproof housing 110 may be a sealed plastic housing enclosing multiple antennas covering multiple wireless services. Housing 110 may support a variety of services using a variety of antennas, such as cellular antennas, a personal communications service (PCS) antenna, a global positioning system (GPS) antenna, and a satellite radio antenna, and other antennas. In the example provided, first antenna cluster 70A is disposed in waterproof housing 110 mounted to a vehicle body on the outside of vehicle 12.

Transmission cable 112 communicates coverage band signals from first antenna cluster 70A to telematics unit 24. In the example provided, transmission cable 112 is a coaxial cable having a center conductor surrounded by an insulating layer and a tubular conductor, as will be appreciated by those with ordinary skill in the art.

Figure 3:
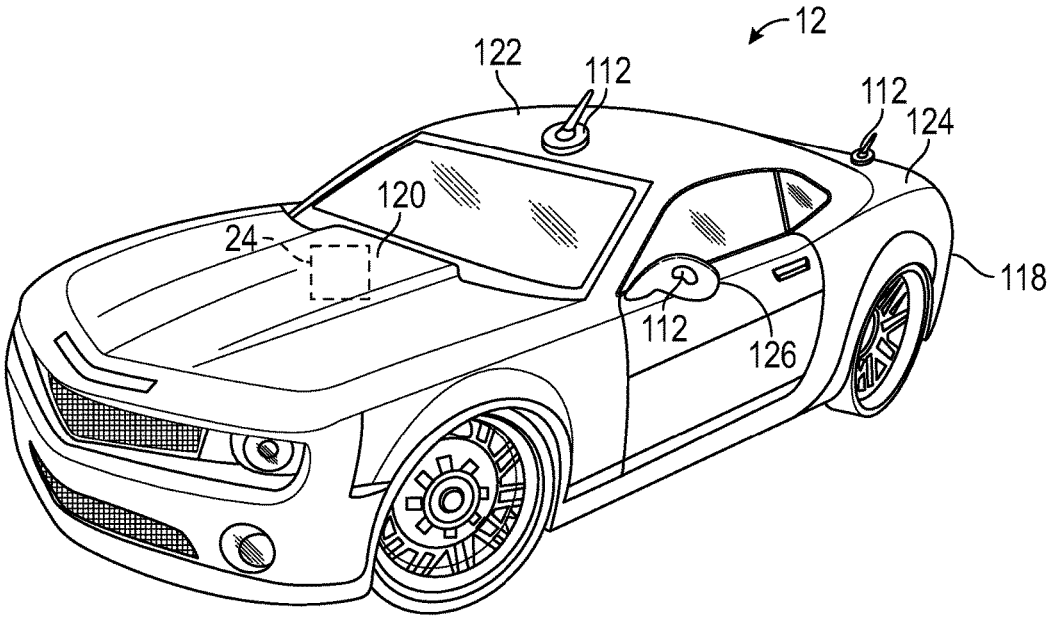
FIG. 3 is a diagram illustrating a non-limiting example of a vehicle made in accordance with the teachings herein.

Referring now to FIG. 3, and with continued reference to FIGS. 1-2, vehicle 12 is illustrated in accordance with teachings of the present disclosure. Vehicle 12 includes a vehicle body 118 with a dashboard 120, a roof 122, a rear trunk lid 124, and a side mirror housing 126. Vehicle body 118 defines a boundary between an inside of the vehicle and an outside of the vehicle. In the example provided, telematics unit 24 is disposed behind dashboard 120 and waterproof housing 110 may be disposed on roof 122, on rear trunk lid 124, or in side mirror housing 126. In some embodiments, waterproof housing 110 is disposed on only one of roof 122, trunk lid 124, and side mirror housing 126.

Figure 4:
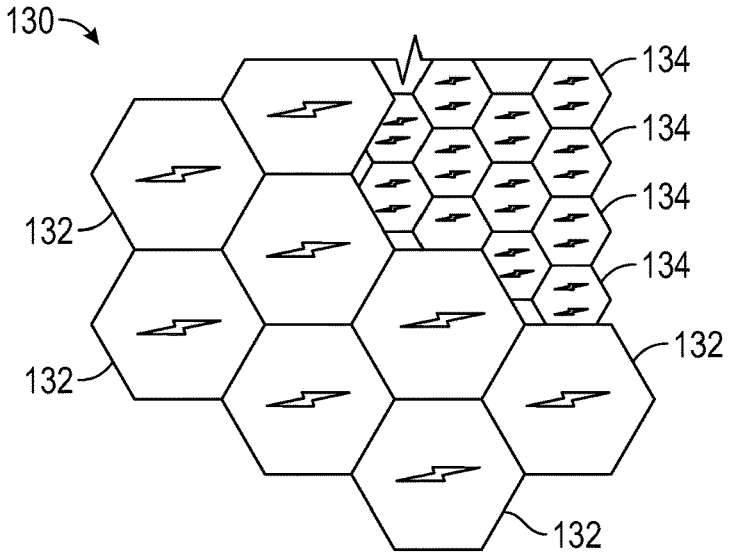
FIG. 4 is a diagram illustrating a non-limiting example of a coverage map for a cellular radio system according to an embodiment.

Referring now to FIG. 4, and with continued reference to FIGS. 1-3, a coverage map 130 for a cellular radio system is illustrated in accordance with the teachings of the present disclosure. Coverage map 130 is composed of coverage band cells 132 and capacity band cells 134. Cells 132 and 134 represent the areas of coverage map 130 that are serviced by different antennas on cell towers 48. The locations and number of cell towers 48 may vary without departing from the scope of the present disclosure. In the example provided, a cell tower 48 is located in the center of each cell 132 and 134.

Coverage band cells 132 provide cellular telephone service to vehicle 12 using coverage band cellular telephone frequencies. As described above, coverage band cellular telephone frequencies have frequencies below about 2 GHz. The low frequencies used in coverage band cells 132 permit large coverage areas to provide cellular telephone service across large areas. For example, coverage band cells 132 may be located in rural areas where there are no dense populations.

In contrast, capacity band cells 134 provide cellular telephone service to vehicle 12 using both capacity and coverage band cellular telephone frequencies. As described above, capacity band cellular telephone frequencies have frequencies above about 2 GHz. Capacity band cells 134 represent areas where many cellular service customers are typically operating at any given time, such as in urban and suburban areas. In order to increase the capacity of the overall wireless carrier system 14, capacity band cells 134 are sized smaller than the usable range of the capacity band cellular telephone signals, as will be appreciated by those with ordinary skill in the art. Accordingly, signal availability at both capacity and coverage band cellular telephone frequencies is high even at edges of each capacity band cell 134. Therefore, the gain of internal second antenna cluster 70B is sufficient to operate effectively on all cellular telephone frequencies used in capacity band cells 134. Furthermore, capacity band cellular telephone signals are typically not used in coverage band cells 132. Therefore, external capacity band antennas may be omitted to reduce the size, complexity, and cost of the external antennas on vehicle 12.

Figure 5:
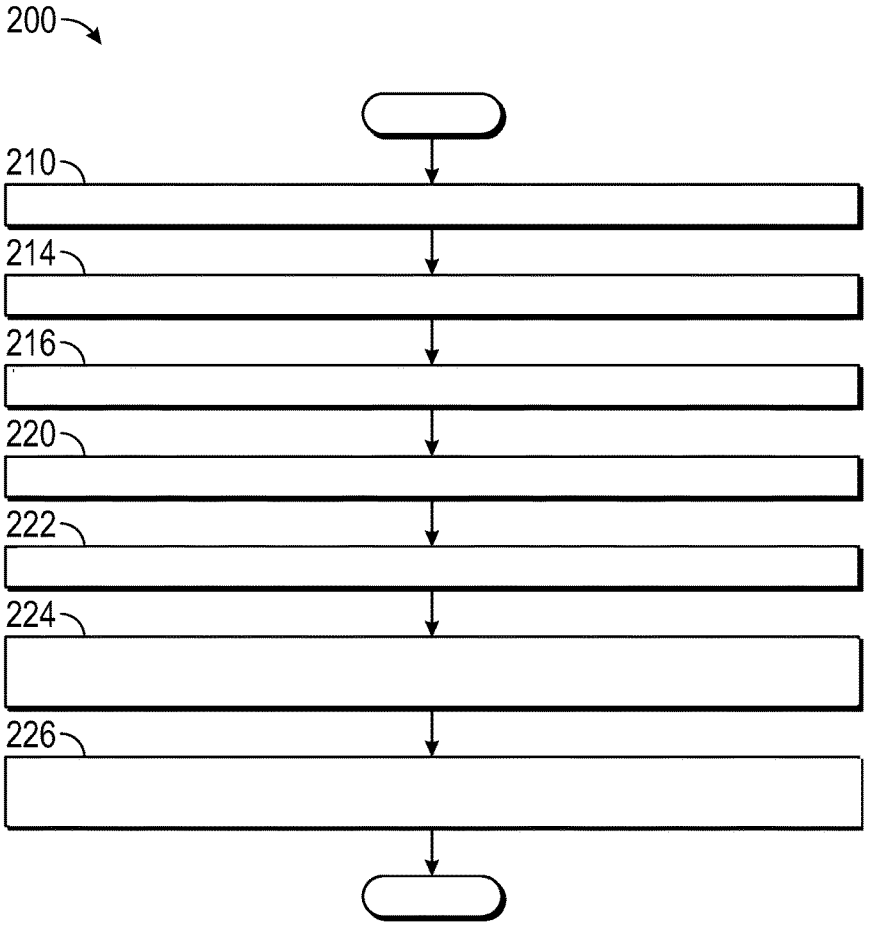
FIG. 5 is a flowchart illustrating a non-limiting example of a method of electronic communication in a vehicle in accordance with the teachings herein.

Referring now to FIG. 5, and with continued reference to FIGS. 2-4, a flow chart illustrates a method 200 of electronic communication in a vehicle. In the example provided, method 200 is performed with use of system 100. It should be understood, however, that method 200 is not limited to use with system 100 and may be employed with other cellular systems that dispose coverage band antennas on an external surface of a vehicle and that dispose capacity band antennas on an internal surface of a vehicle. As can be appreciated in light of the disclosure, the order of operation within method 200 is not limited to the sequential execution as illustrated in FIG. 5, but may be performed in one or more varying orders as applicable and in accordance with the requirements of a given application.

A vehicle is operated in a location in operation 210. For example, vehicle 12 may be operated at a location within coverage band cells 132 or within capacity band cells 134 in operation 210. A first antenna cluster receives a coverage band signal at an outside of the vehicle in operation 214 and the first antenna cluster transmits the coverage band signal at the outside of the vehicle in operation 216. For example, first antenna cluster 70A may receive and transmit the coverage band signal between telematics unit 24 and cell tower 48. In other words, method 200 includes receiving and transmitting coverage band signals with a first antenna cluster mounted on an outside of the vehicle and configured to operate at coverage band cellular telephone frequencies.

A second antenna cluster receives a capacity band signal at an inside of the vehicle in operation 220 and receives the coverage band signal at an inside of the vehicle in operation 222. The second antenna cluster transmits the capacity and coverage band signals at the inside of the vehicle in operation 224. For example, second antenna cluster 70B may receive and transmit the capacity and coverage band signals at the inside of the vehicle in operations 220, 222, and 224 when vehicle 12 is in a capacity band cell 134. In other words, method 200 includes receiving and transmitting capacity band signals with a second antenna cluster disposed in the inside of the vehicle and configured to operate at capacity band cellular telephone frequencies. It should be appreciated that coverage band signals may also be received at first antenna cluster 70A when vehicle 12 is in a capacity band cell 134.

A controller modulates and demodulates the capacity and coverage band signals in operation 226. For example, telematics unit 24 may modulate and demodulate the capacity and coverage band signals.

While various exemplary embodiments have been presented in the foregoing detailed description, it should be appreciated that a vast number of variations exist. It should also be appreciated that the exemplary embodiments are only examples, and are not intended to limit the scope, applicability, or configuration of the disclosure in any way. Rather, the foregoing detailed description will provide those skilled in the art with a convenient road map for implementing the exemplary embodiments. It should be understood that various changes can be made in the function and arrangement of elements without departing from the scope of the disclosure as set forth in the appended claims and the legal equivalents thereof.

The invention claimed is:

1. A vehicle comprising:

a vehicle body defining a boundary between an inside of the vehicle and an outside of the vehicle;

a first antenna cluster mounted on the outside of the vehicle and configured to operate at coverage band cellular telephone frequencies using coverage band signals, wherein the first antenna cluster includes multiple first antennas clustered together; and a second antenna cluster disposed in the inside of the vehicle and configured to operate at capacity band cellular telephone frequencies using capacity band signals, wherein the second antenna cluster includes multiple second antennas clustered together.

2. The vehicle of claim 1, where the first antenna cluster composes an entirety of external cellular antennas of the vehicle.

3. The vehicle of claim 2, wherein the first antenna cluster is disposed in a waterproof housing mounted to the vehicle body on the outside of the vehicle.

4. The vehicle of claim 1, further comprising a third antenna cluster disposed in the inside of the vehicle and configured to operate at the coverage band cellular telephone frequencies.

5. The vehicle of claim 1, wherein the coverage band cellular telephone frequencies are below about 2 GHz.

6. The vehicle of claim 5, wherein the capacity band cellular telephone frequencies are above about 2 GHz.

7. The vehicle of claim 1, further comprising a telematics unit configured to demodulate the capacity band signals and the coverage band signals, wherein the telematics unit is communicatively coupled with the first antenna cluster and the second antenna cluster.

8. The vehicle of claim 7, further comprising a transmission cable coupled between the first antenna cluster and the telematics unit.

9. The vehicle of claim 8, wherein the second antenna cluster is coupled directly to the telematics unit.

10. The vehicle of claim 1, wherein the vehicle body includes a roof, and wherein the first antenna cluster is mounted to the roof.

11. The vehicle of claim 1, wherein the vehicle body includes a rear trunk lid, and wherein the first antenna cluster is mounted to the rear trunk lid.

12. The vehicle of claim 1, wherein the vehicle body includes a side mirror housing, and wherein the first antenna cluster is mounted to the side mirror housing.

13. A method of electronic communication in a vehicle, the method comprising:

receiving and transmitting coverage band signals with a first antenna cluster of multiple first antennas mounted on an outside of the vehicle and configured to operate at coverage band cellular telephone frequencies; and receiving and transmitting capacity band signals with a second antenna cluster of multiple second antennas disposed in the inside of the vehicle and configured to operate at capacity band cellular telephone frequencies.

14. The method of claim 13, further comprising modulating the coverage band signals and the capacity band signals transmitted at the first antenna cluster and the second antenna cluster with a telematics unit in the vehicle.

15. The method of claim 14, further comprising demodulating the coverage band signals and the capacity band signals received at the first antenna cluster and the second antenna cluster with the telematics unit.

16. The method of claim 13, further comprising receiving and transmitting cover band signals with the second antenna cluster.

17. A vehicle communications system comprising:

a first antenna cluster configured to mount on the outside of the vehicle and to operate at coverage band cellular telephone frequencies using coverage band signals, wherein the first antenna cluster includes multiple first antennas clustered together; and a second antenna cluster configured to be disposed in the inside of the vehicle and to operate at capacity band cellular telephone frequencies using capacity band signals, wherein the second antenna cluster includes multiple second antennas clustered together.

18. The vehicle communications system of claim 17, further comprising a telematics unit operably coupled with the first antenna cluster and the second antenna cluster.

19. The vehicle communications system of claim 17, wherein the first antenna cluster composes an entirety of cellular antennas that are configured to mount on the outside of the vehicle.

20. The vehicle communications system of claim 19, further comprising a waterproof housing configured to mount on the outside of the vehicle, and wherein the first antenna cluster is disposed in the waterproof housing.

* * * * *